US007222618B2

(12) United States Patent
Galambos et al.

(10) Patent No.: US 7,222,618 B2
(45) Date of Patent: May 29, 2007

(54) CONCRETE CUTTING SAW

(75) Inventors: Gerald Galambos, Greenville, MI (US); Steven Haggart, Grand Rapids, MI (US)

(73) Assignee: Hartwick Capital LLC, Grand Rapids, MI (US)

( * ) Notice: Subject to any disclaimer, the term of this patent is extended or adjusted under 35 U.S.C. 154(b) by 0 days.

(21) Appl. No.: 11/329,617

(22) Filed: Jan. 11, 2006

(65) Prior Publication Data

US 2006/0157045 A1 Jul. 20, 2006

Related U.S. Application Data

(60) Provisional application No. 60/644,120, filed on Jan. 14, 2005.

(51) Int. Cl.
*B28D 1/04* (2006.01)

(52) U.S. Cl. ..... 125/13.01; 125/13.03

(58) Field of Classification Search ..... 125/13.01, 125/12, 14, 36; 299/39.1, 39.3
See application file for complete search history.

(56) References Cited

U.S. PATENT DOCUMENTS 3,747,981 A * 7/1973 Zuzelo ..... 299/39.3
4,375,212 A 3/1983 Santschi
4,664,645 A * 5/1987 Muck et al. ..... 474/84
4,787,678 A * 11/1988 Holmes et al. ..... 299/39.3
5,429,420 A 7/1995 Johnson
5,452,943 A 9/1995 Campbell
5,680,854 A * 10/1997 Kingsley et al. ..... 125/13.03
5,724,956 A * 3/1998 Ketterhagen ..... 125/13.01
5,809,985 A * 9/1998 Kingsley et al. ..... 125/13.01
6,019,433 A 2/2000 Allen
6,318,353 B1 11/2001 Edwards et al.
6,758,188 B2 7/2004 Wooldridge
2002/0117161 A1 8/2002 Meister
2006/0060179 A1 * 3/2006 Kingsley et al. ..... 125/13.01

* cited by examiner

*Primary Examiner*—Dung Van Nguyen
(74) *Attorney, Agent, or Firm*—Barnes & Thornburg LLP

(57) ABSTRACT

A saw for cutting a surface with a rotatable blade. The saw includes a rotary motor having a rotatable rotor and a rotatable output shaft. A rotatable blade mounting member is operatively coupled to the output shaft of the rotary motor such that rotation of the output shaft causes rotation of the blade mounting member. A steering assembly having one or more wheels provides steering control of the saw.

19 Claims, 9 Drawing Sheets

Top View

58

CONCRETE CUTTING SAW

RELATED APPLICATIONS

This application claims the benefit of U.S. Provisional Application No. 60/644,120, filed Jan. 14, 2005.

BACKGROUND

Concrete cutting saws, often referred to in the industry as slab saws, are used for cutting concrete and bituminous structures such as roadways and airport runways. As an example, when large slabs of concrete are poured, the surface of the slab is cut to divide the slab into smaller sections to relieve stresses and to allow for some degree of expansion and contraction which may otherwise undesirably crack the slab. Slab saws are also used to cut the edges of a portion of a slab that is to be removed. Additionally, such saws may be used inside of a building to perform similar functions on concrete floors.

Slab saws include a frame or housing typically mounted on wheels. Subject to the practicalities of saw size, a large, high horsepower reciprocating piston engine such as a Wisconsin 65HP engine has typically been used in concrete saws due to their relatively high torque for a given horsepower rating. Automobile engines such as a V6 engine have also been used to power large slab saws, but the resulting size of this saw has limited its utility and acceptance. However, reciprocating engines have a very steep torque curve in that the torque produced by the engine typically falls substantially as RPM decreases or increases around a relatively narrow ideal range. The saw includes a large diameter diamond tipped masonry cutting saw blade. When the saw is started, the operator positions the saw along a guide line, such as a chalk line, and lowers the saw blade into the concrete. As the saw blade cuts through the concrete the slab saw advances guided by the operator following the chalk line. A lubricant such as water is fed to the saw blade to lubricate, remove material, contain dust and cool the blade.

Current slab saws typically use a belt and pulley system to drive the saw blade. A drive pulley is placed directly on the crankshaft or fly wheel of the motor. Power is transferred to the blade through a series of subsequent belts and pulleys. It is preferable to rotate the saw blade at a particular number of revolutions per minute (RPM) while retaining as much horsepower (HP) and torque as possible. The desired RPM for a given saw blade is primarily a function of its diameter. Smaller diameter blades are spun faster than larger diameter blades. A rule of thumb is to achieve 10,000 inches of blade rotation per foot of cut. Thus a small diameter blade spins faster (at a higher RPM) to achieve the 10,000 inches of blade rotation per foot of cut at the same linear cutting pace than does a larger diameter blade.

Current slab saws require changing the RPM of the motor, and thereby the horsepower and torque output of the motor, in order to change the RPM of the saw blade. With the RPM change, the reciprocating engines of current art suffer from sometimes dramatic drops in torque output. The alternative is to change the size of the various pulleys in the drive system which is cumbersome and time and labor intensive, and while this can sometimes be accomplished, the necessary sheave sizes can require the reciprocating engine saw to be even larger and more cumbersome. The manipulation of the motor RPM can cause the motor to be operated outside of its operating specifications thus shortening its life and utility. As an example, the industrial version of a V6 motor has a maximum RPM of approximately 5,000 RPM and is recommended to be operated at approximately 2,750 RPM. With a typical one-to-one pulley set up, such a motor can run a saw blade having a recommended operating speed of 2,750 RPM at its recommended RPM. However, use of a smaller diameter blade requiring a higher blade RPM could require increasing the RPM's of the motor to its limit. On the other hand, the use of a larger diameter saw blade would require lowering the RPM of the motor such that the motor will not function well enough to deliver constant horsepower and torque to the saw blade. Consequently, with current slab saws either the motor or the saw blade are often used outside of its recommended range of RPM in order to accommodate the use of different diameter saw blades with the motors currently in use. The steep torque curve of reciprocating engines allows for only limited sheave changes. Versions of the V6 saw, where some changing of the sheaves or drive belts has been incorporated to manipulate RPM, rendered it to be even larger and further reduced the circumstances for which it is of suitable size.

Slab saws can be categorized in a fairly straightforward manner: small, large, and specialty. The utility of a small saw is generally not constrained by its size but rather its power in general commercial use. It is used where access or space limits do not allow a larger saw, for example egress via a 30 inch wide door. A slab saw using an 18HP Honda engine would be an example of this category. Large saws conversely generate substantially higher power, but are constrained by their size in many instances. A saw using a 78HP Deutz diesel would be an example of this category. However, these saws generally do not fit through even 36 inch wide doors. Specialty saws are generally so large or of unique configuration such that their application is generally to a narrow range of functions, such as a deep cut saw for cutting runways at airports for example. It is uncommon for any of the above saws to be configured to use a blade smaller than an 18 inch diameter and larger than a 54 inch diameter with the vast majority of blade use between these two extremes.

Slab saws also tend to veer away from the line of cut during operation as a result of the rotation of the saw blade acting as a drive wheel. Consequently, operation of the slab saw requires the operator to apply significant controlling pressure to the slab saw in order to properly steer the slab saw. A sufficient amount of steering force may be required to be applied to the slab saw by the operator resulting in strain and fatigue of the operator. The amount of steering force required is a direct function of the horsepower and torque of the saw.

SUMMARY

A relatively small footprint, high torque saw for cutting a surface with a rotatable blade. The saw includes a frame base and a rotary motor attached to the frame base. The rotary motor includes one or more rotatable tri-lobular rotors. The rotary motor includes an output shaft adapted to rotate about a first rotational axis. A power transmission system operatively couples the output shaft of the rotary motor to a blade mounting member. The blade mounting member is adapted to rotate about a second rotational axis and is adapted to receive the blade. The power transmission system operatively couples the output shaft of the rotary motor with the blade mounting member such that rotation of the output shaft of the rotary motor causes rotation of the blade mounting member and the blade. The power transmission system reduces the high RPM of the rotary motor and increases the torque at the blade mounting member. The saw includes a steering assembly pivotally coupled to the base frame. The steering assembly includes one or more first wheels that are rotatably attached to a wheel mount. The one or more first wheels are rotatable with respect to the wheel mount about a generally horizontal third rotational axis. The wheel mount is pivotally attached to the frame base such that the wheel mount and the one or more first wheels are selectively pivotal with respect to the frame base about a pivot axis that is generally vertical and perpendicular to the third rotational axis. An actuator selectively pivots the wheel mount and the one or more first wheels about the pivot axis with respect to the base frame to steer the movement of the saw. The saw may also include a lift mechanism including one or more second wheels, a lever pivotally attached to the frame base and to the one or more second wheels, and an actuator attached to the lever. The actuator is adapted to selectively pivot the lever and the one or more second wheels about a horizontal axis with respect to the frame base such that the position of the blade mounting member and blade with respect to the surface to be cut is selectively adjustable. The operating RPM of the rotary motor can be selectively adjusted to rotate a range of blade sizes at a desired RPM.

BRIEF DESCRIPTION OF THE DRAWING FIGURES

DETAILED DESCRIPTION

Figure 1:
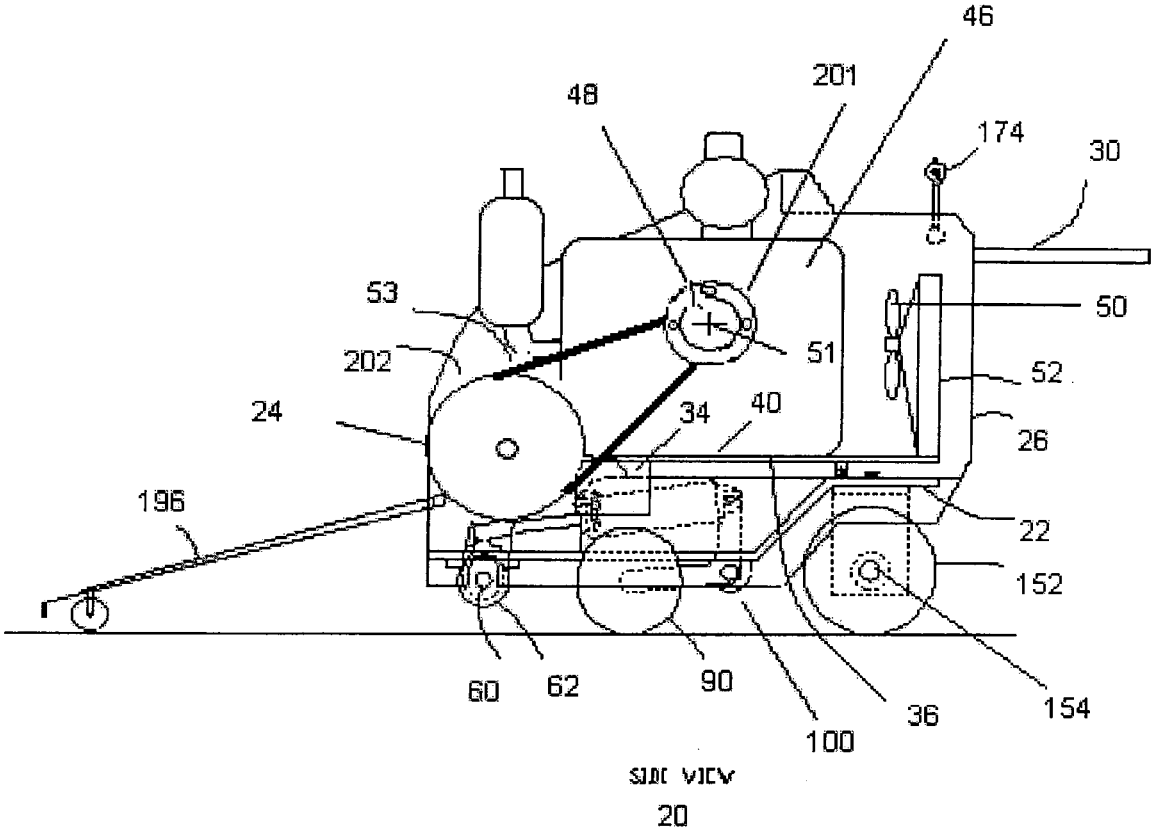
FIG. 1 is a side elevational view of the concrete cutting saw as set forth in the present disclosure.
Figure 2:
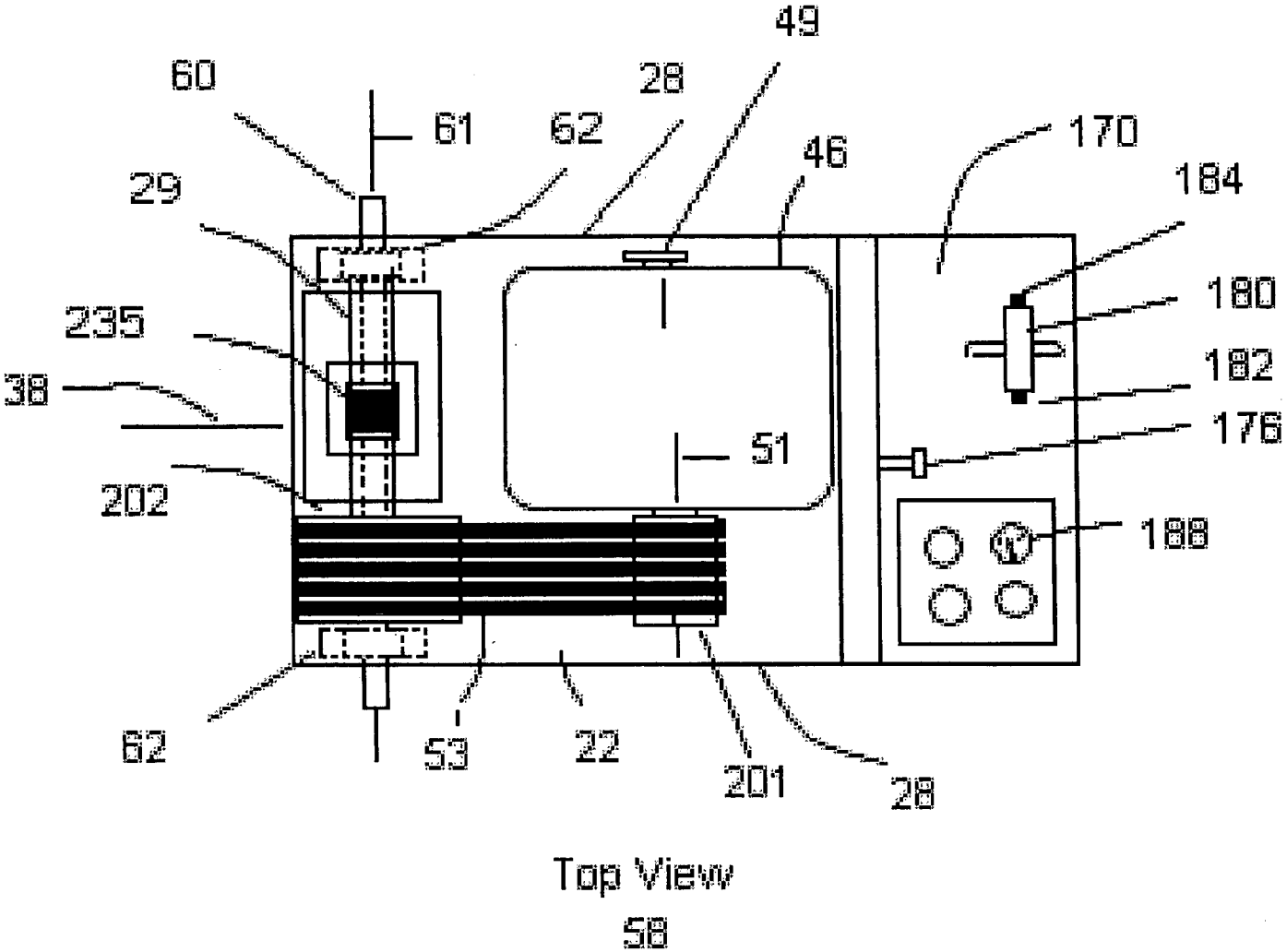
FIG. 2 is a top plan view of the concrete cutting saw.

While the present disclosure may be susceptible to embodiment in different forms, there is shown in the drawings, and herein will be described in detail, embodiments with the understanding that the present description is to be considered an exemplification of the principals of the disclosure and is not intended to be exhaustive or to limit the disclosure to the details of construction and the arrangements of components set forth in the following description or illustrated in the drawings.

A saw 20 is illustrated in FIGS. 1 through 10. The saw 20 is of a type often referred to as a concrete cutting saw or a slab saw. However, the saw 20 is adapted for use in cutting various types of materials in addition to concrete structures, including but not limited to asphalt and bituminous structures. The saw 20 includes a housing having a frame base 22 that may be formed from a plate of steel that is approximately three-quarter inch thick. The frame base 22 may have a footprint size, such as approximately thirty-one inches wide or less, that will allow the saw to wheel through a 36 inch wide door (The blade mounting member 60 extends outwardly beyond each side of the frame base 22 approximately 2.5 inches). The overall width of the saw 20 is approximately 36 inches wide or less. The saw 20 includes a generally vertical front panel 24, rear panel 26 and a pair of side panels 28. The panels 24, 26 and 28 may be made from steel. A handle 30 is attached to and extends outwardly from the rear panel 26.

The saw 20 also includes an adjustable motor mount 34 including a mounting frame 36 that is slidably coupled to the frame base 22 for selective sliding movement with respect to the frame base 22 along a central longitudinal axis 38 of the saw 20. The mounting frame 36 includes a generally horizontal mounting member 40 such as a plate. While the adjustable motor mount 34 is selectively slideable with respect to the frame base 22 to enable easy access to the motor, the motor mount 34 may be selectively locked in place with respect to the frame base 22 with fasteners or the like. A motor 46, such as an internal combustion engine is attached to the mounting member 40 of the motor mount 34. The motor 46 is preferably a rotary motor or engine having one or more rotatable tri-lobular rotors, as opposed to linearly reciprocating pistons as commonly found in V6 and V8 engines. A rotary motor is preferred over a reciprocating engine as it provides a much more constant torque output over its range of operating RPM, and particularly at the lower end of its RPM range than does a reciprocating engine and generates significantly less vibration. However, a rotary motor typically generates lower torque for a given horsepower rating than reciprocating engines. The motor 46 includes a rotatable output shaft 48 and a rotatable accessory shaft 49. The rotary motor has a maximum RPM of the output shaft of approximately 9,000 RPM. The motor 46 provides approximately 170 peak HP (+/−10HP) and up to approximately 130 foot-pounds (ft-lbs) of torque during operation over a recommended operating range of approximately 1700 RPM to approximately 9000 RPM. The saw 20 is designed to operate the motor 46 between 2000 RPM and 5600 RPM of the output shaft 48 (useable RPM) to properly rotate commonly used blade sizes. The motor incorporates an RPM governor to insure operation within this range. While the motor may operate at RPM as high as 9000, other typical components of a slab saw such as bearings and belts do not hold up at these high speeds. The output shaft 48 is adapted to rotate about a central linear rotational axis 51 that is generally perpendicular to the longitudinal axis 38.

The motor 46 may alternatively provide approximately 85 peak HP (+/−5HP) and up to 65 ft-lbs of torque, such that the 85 HP rotary motor is smaller in physical size than the 170 HP motor, and such that the overall width of the saw 20 may be further reduced to approximately 30 inches wide or less, with a frame base 22 having a width of approximately twenty-five inches wide or less, to allow entry through a 30 inch wide door. Neither saw will require sheave, belt or pulley changeovers to maintain operations within blade and engine specifications.

The saw 20 includes a radiator 52 that is located adjacent a fan 50 and that is coupled in fluid communication with the motor 46. The saw 20 also includes an electrical system including a battery 54 in electrical communication with the motor 46. The electrical system includes an alternator that is adapted to be driven by the motor 46 and that is in electrical communication with the battery 54.

The saw 20 also includes a power transmission system 58 and a saw blade mounting member 60. The saw blade mounting member 60 may comprise an elongated shaft. The saw blade mounting member 60 is rotatably mounted to the frame base 22 by one or more bearing members 62. The blade mounting member 60 is rotatable about its central longitudinal horizontal axis 64 with respect to the frame base 22. The rotational axis 64 is substantially perpendicular to the longitudinal axis 38 of the saw 20 and parallel to the rotational axis 51. A generally circular and disc-shaped saw blade is adapted to be removably attached to the blade mounting member 60 for conjoint rotation therewith about the axis 64. The saw blade is adapted to cut concrete, asphalt, bituminous concrete and other structures.

Figure 7:
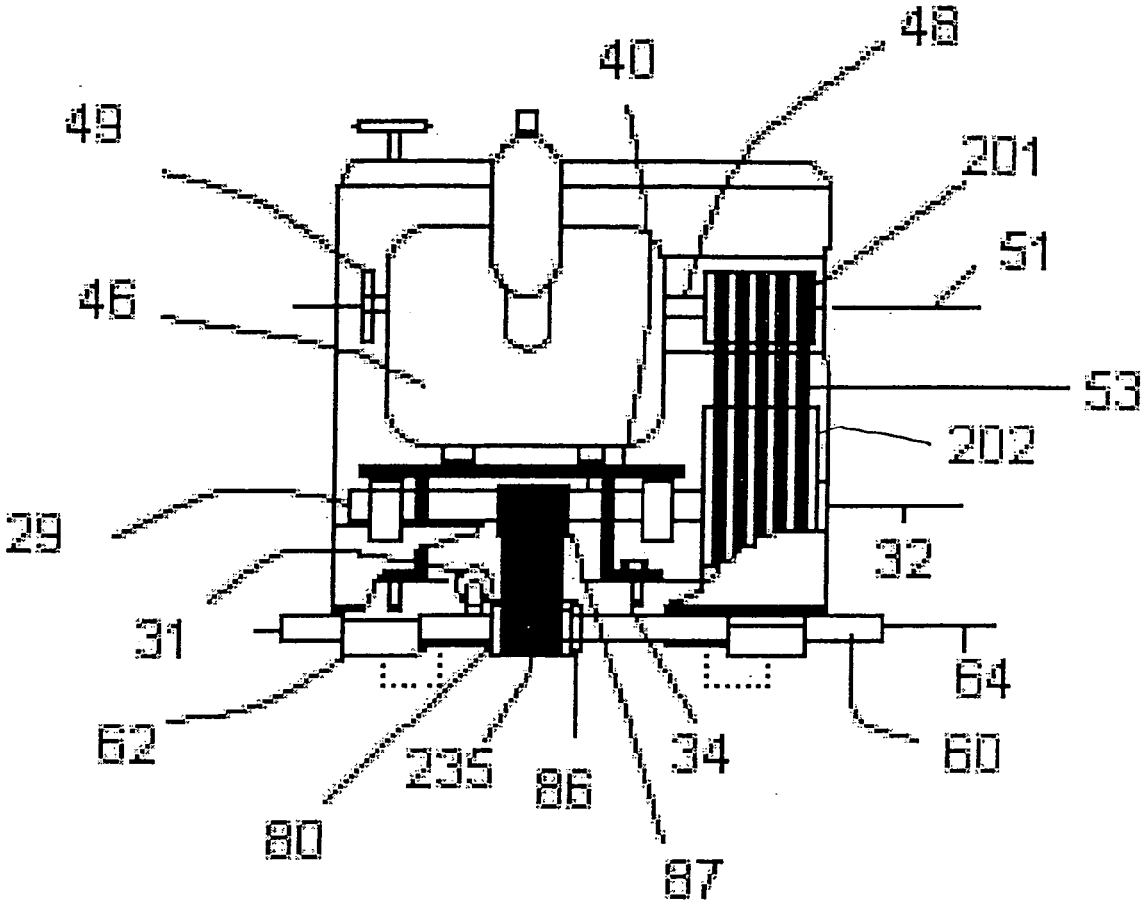
FIG. 7 is a front view of the blade drive assembly of the concrete cutting saw.
Figure 8:
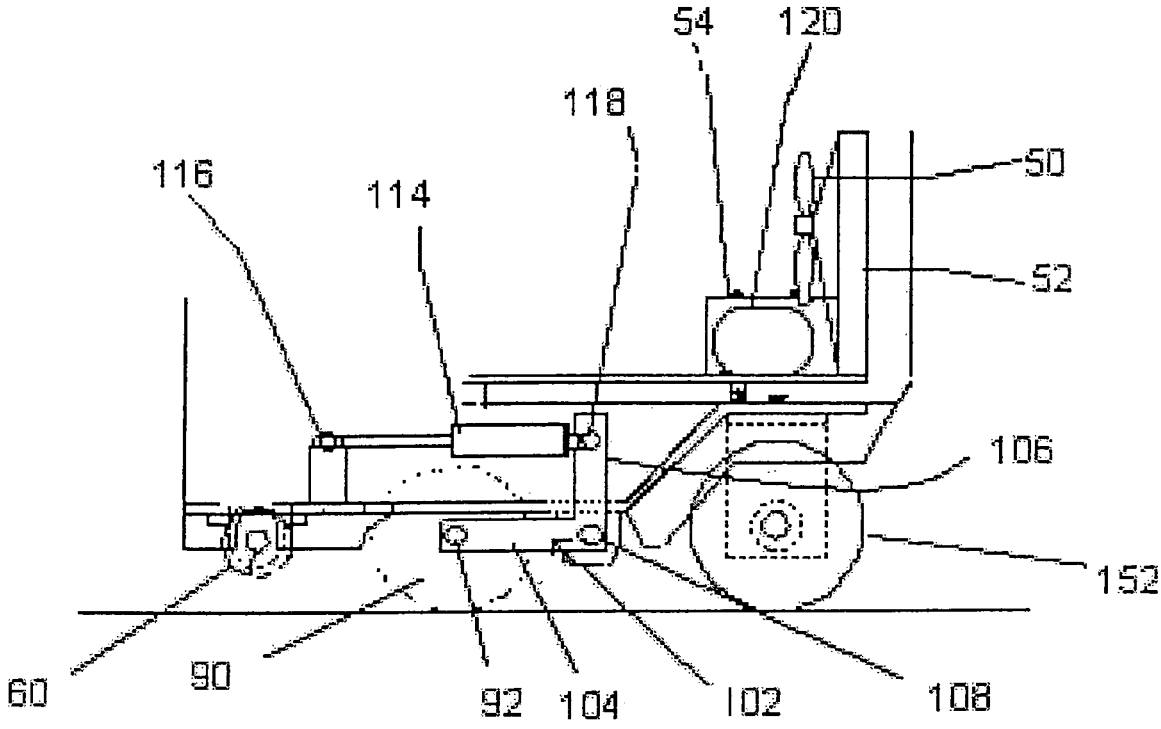
FIG. 8 is a side view of the lift mechanism of the concrete cutting saw.

The power transmission system as shown in FIG. 7, includes a fixed pulley 201 mounted to the output shaft 48 of the motor 46 for conjoint rotation with the shaft 48 about the axis 51. The output shaft fixed pulley 201 is rotationally connected by a parallel series of endless belts 53 to a larger diameter pulley 202 which is mounted to a rotatable shaft 29. The larger diameter pulley 202 may be a flywheel weighing approximately 50 pounds or more. The possible flywheel effect and the movement transfer from the smaller diameter fixed pulley 201 to the larger diameter fixed pulley 202 which reduces the RPM of the blade mounting member 60 relative to that of the output shaft 48 between 2-to-1 and 3-to-1, further increases the effective torque of the 170HP motor to approximately 350 ft-lbs at the blade, and the effective torque of the 85HP motor to approximately 130 ft-lbs at the blade.

The shaft 29 is rotationally mounted to the mounting frame 36 and is adapted to rotate about a horizontal central longitudinal axis 32 that is substantially parallel to the axes 51 and 64. The rotatable shaft 29 is connected to the rotatable blade mounting member 60 by a single serpentine belt 235 running between a sheave 87 attached to the rotatable shaft 29 and a sheave 80 attached to the rotatable blade mounting member 60.

As shown in FIG. 7, the sheave 80 is coupled to the rotatable blade mounting member 60 for conjoint rotation by a shear pin 86. The shear pin 86 is adapted to shear and break if an excessive amount of torque is supplied to the sheave 80 by the rotatable blade mounting member 60 such as, for example, in the event that the saw blade becomes jammed in the surface being cut. The rotatable blade mounting member 60 will rotate freely with respect to the sheave 80, and the sheave 80 will rotate freely with respect to the blade mounting member 60, when the shear pin 86 breaks. The sheaves and belts described herein may alternatively comprise sprockets and chains.

Figure 10:
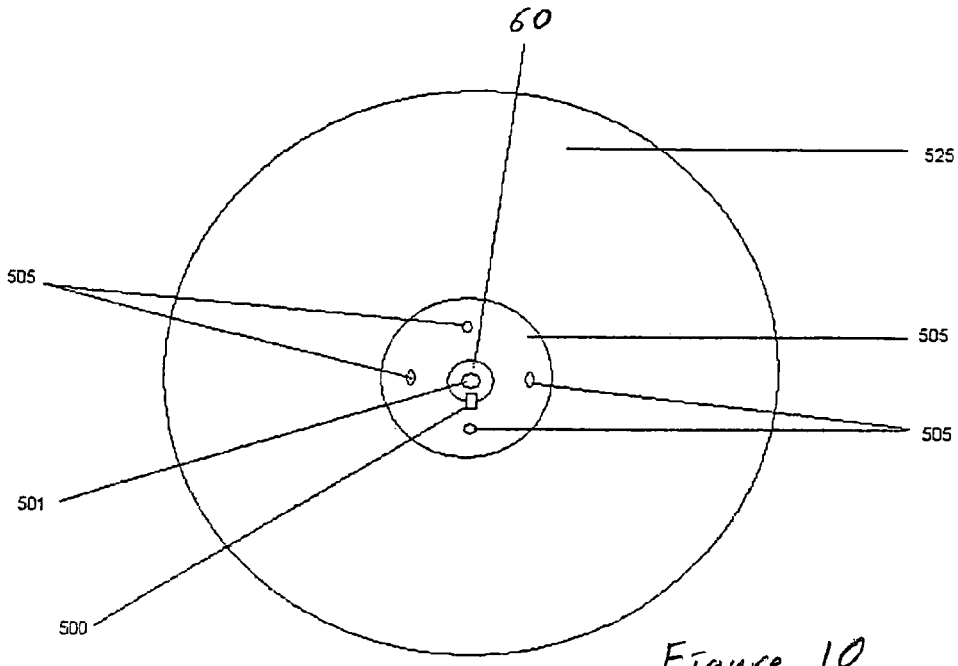
FIG. 10 is a side elevational view of the alternative shear pin arrangement of FIG. 9.
Figure 9:
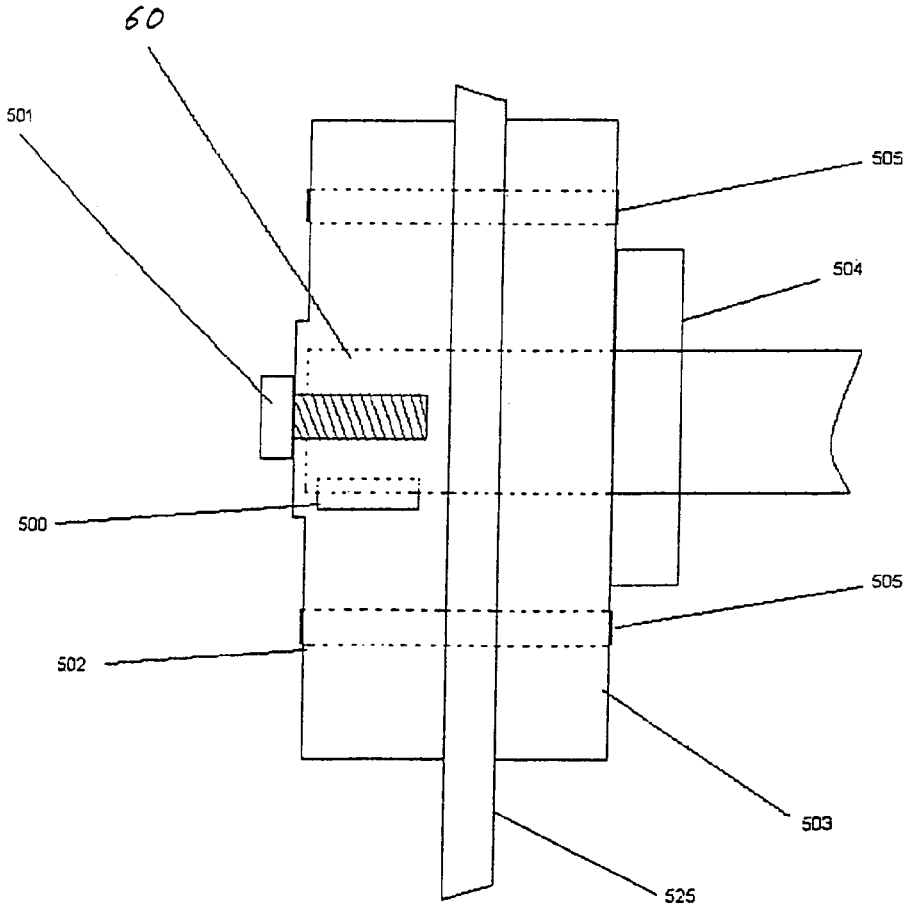
FIG. 9 is a front elevational view of an alternative shear pin arrangement.

FIGS. 9 and 10 illustrate an alternative shear pin arrangement that may be utilized. In this arrangement, multiple shear pins 505 extend through the cutting blade 525 and an interior collar 503 and exterior collar 502. The interior collar 503, exterior collar 502, and blade 525 are held against a fixed shaft collar 504 by a bolt 501 counter-bored into the blade mounting member 60. The exterior collar 502 is conjoined to the blade mounting member 60 by a key 500 to cause the blade 525 to rotate with the blade mounting member 60. Should the blade 525 become pinched or encounter other excessive forces, the shear pins 505 will shear and allow the blade 525 to rotate freely relative to the exterior collar 502 and blade mounting member 60 protecting the drive train and motor 46 from damage.

The saw 20 also includes one or more front wheels 90 rotatably coupled to a shaft 92 having a central horizontal axis 94. The shaft 92 and wheels 90 are coupled to the frame base 22 by a lift mechanism 100. The lift mechanism 100 includes one or more generally L-shaped levers 102. Each lever 102 includes a first arm 104 and a second arm 106. The levers 102 are attached at the inner ends of the arms 104 and 106 to a rotatable shaft 108 having a central axis 110. The shaft 108 is rotationally coupled to the frame base 22 by one or more bearings 112. The axis 110 is substantially horizontal and parallel to the axis 94 of the shaft 92 and the axis 64 of the blade mounting member 60.

The lift mechanism 100 also includes one or more actuators 114. Each actuator 114 may comprise a hydraulic cylinder having a housing and an extendable and retractable ram. Each actuator 114 includes a first end 116 pivotally attached to the frame base 22 adjacent the blade mounting member 60 and a second end 118 pivotally attached to the outer end of the second arm 106 of the lever 102. The ends 116 and 118 of the actuator 114 are selectively extendable and retractable with respect to one another along a linear axis. The actuator 114 is coupled in fluid communication with a power supply device 120, such as an electrically operated hydraulic pump. The hydraulic pump supplies and withdraws hydraulic fluid from the hydraulic cylinder to thereby selectively extend or retract the ram with respect to the housing of the hydraulic cylinder and thereby shorten or lengthen the distance between the ends 116 and 118 of the actuator 114. The power supply device 120 may be electrically connected to the alternator that is driven by the motor 46 and may also be electrically connected to the battery 54.

When the first and second ends 116 and 118 of the actuator 114 are retracted with respect to one another, the actuator 114 pivots the levers 102 and thereby the front wheels 90 about the horizontal axis 110 of the shaft 108 in a counter-clockwise direction as viewed in FIG. 1, thereby vertically lifting or raising the blade mounting member 60 with respect to the surface of the structure that is to be cut. The blade mounting member 60 may be raised above the surface a sufficient distance such that the peripheral edge of the saw blade is spaced completely above the surface to be cut. When the first and second ends 116 and 118 of the actuator 114 are extended with respect to one another, the actuator 114 pivots the levers 102 and front wheels 90 about the horizontal axis 110 in a clockwise direction as shown in FIG. 1, wherein the blade mounting member 60 is lowered with respect to the surface of the structure to be cut. The actuator 114 is adapted to position the blade mounting member 60 at a desired height above the surface to be cut such that the saw blade will provide a saw cut with a desired depth.

The saw 20 also includes a steering assembly 130. The steering assembly 130 includes a wheel mount 132 having a generally horizontal plate 134 and pair of mounting members 136 that extend downwardly from respective ends of the plate member 134. The wheel mount 132 is pivotally attached to the frame base 22 by a pivot member 138, such as a bolt, which is attached to the frame base 22 and that extends through a central aperture in the horizontal plate member 134. The wheel mount 132 is pivotally coupled to the pivot member 138 by a fastener 140 such as a bolt and nut. The steering assembly 130 is thereby adapted to pivot with respect to the frame base 22 about a generally vertical axis 142 extending through the pivot member 138. The pivot axis 142 is generally perpendicular to the longitudinal axis 38, and the axes 64, 94 and 112. A hydraulic drive unit 148 is attached to each mounting member 136 of the wheel mount 132. Each hydraulic drive unit 148 includes a rotatable drive shaft 150. A rear wheel 152 is removably attached to each drive shaft 150 for conjoint rotation therewith. The drive shafts 150 and rear wheels 152 are rotatable about a horizontal linear rotational axis 154 that is generally perpendicular to the pivot axis 142.

Figure 3:
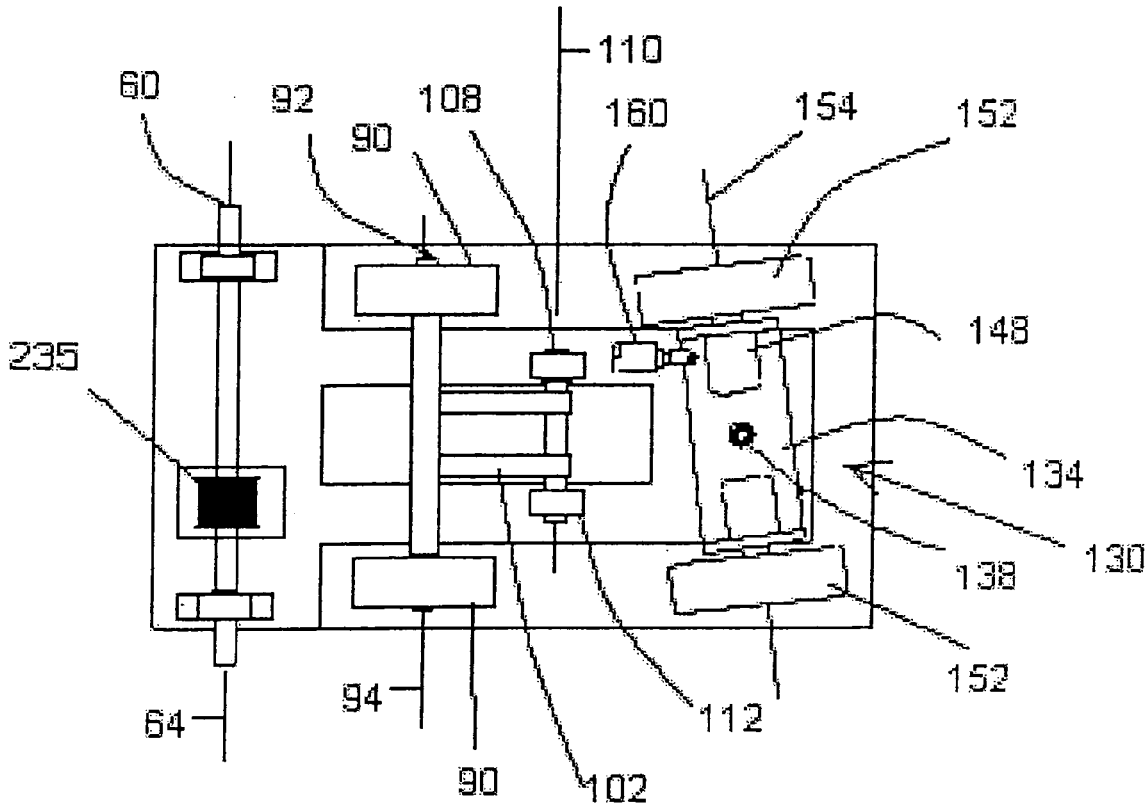
FIG. 3 is a bottom view of the concrete cutting saw.
Figure 4:
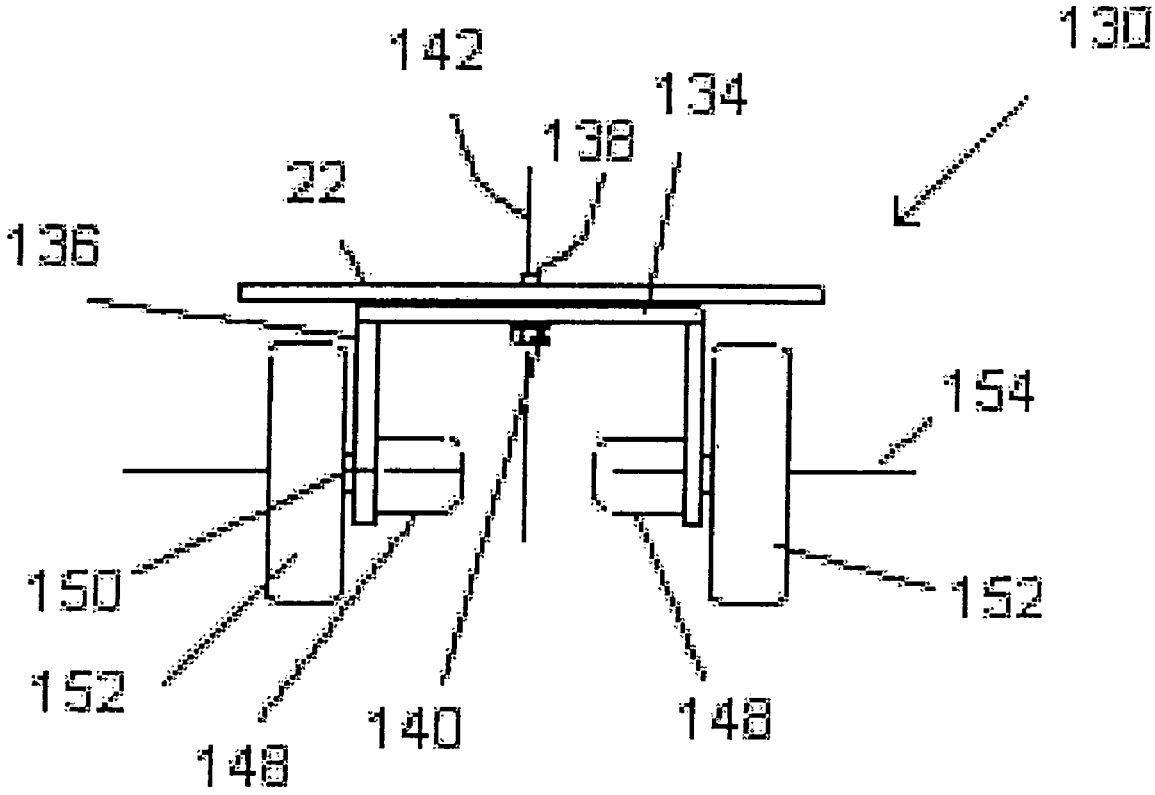
FIG. 4 is a rear view of the steering assembly of the concrete cutting saw.
Figure 5:
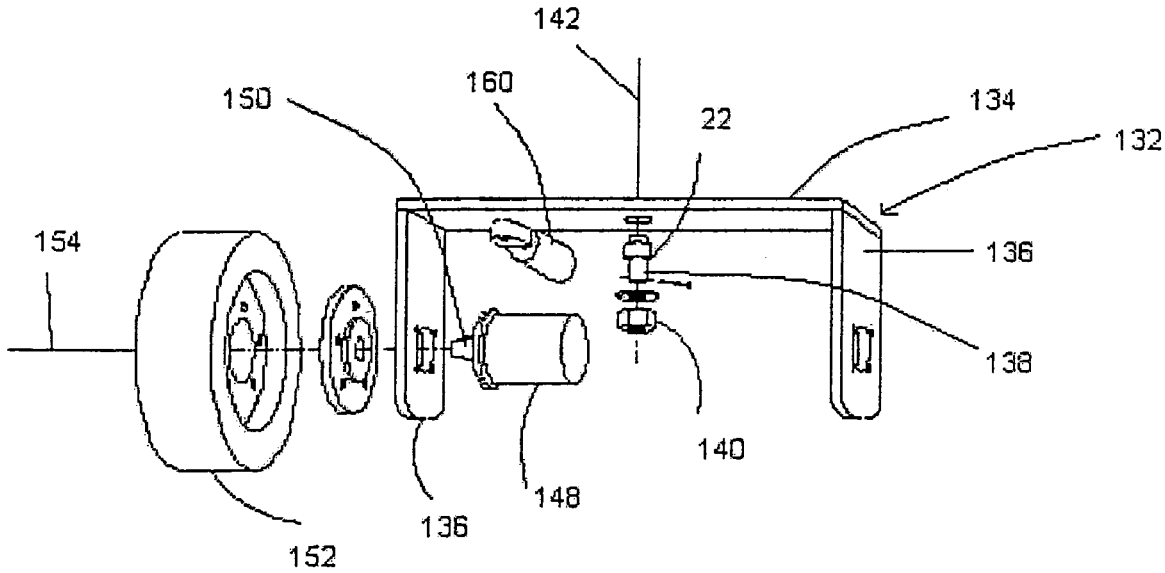
FIG. 5 is a partial exploded view of the steering assembly of the concrete cutting saw.

An actuator 160 is coupled between the horizontal plate member 134 of the steering assembly 130 and the frame base 22. The actuator 160 includes a first end and a second end that are selectively extendable and retractable with respect to one another. The actuator 160 may be a hydraulic cylinder having a housing and an extendable and retractable ram. The first end of the actuator 160 is pivotally coupled to the frame base 22 and the second end is pivotally coupled to the horizontal plate 134 of the wheel mount 132. The first and second ends of the actuator 160 are selectively extendable and retractable along a generally linear axis that is offset from the pivot axis 142. The actuator 160 is coupled in fluid communication with the power supply device 120 such that the power supply device 120 selectively extends and retracts the ends of the actuator 160 as desired. When the ends of the actuator 160 are retracted from a neutral position wherein the axis 154 is parallel to the axis 94, the wheel mount 132 and rear wheels 152 pivot about the pivot axis 142 in a counter-clockwise direction as shown in FIG. 3 such that the saw 20 will turn toward the left when the saw 20 is moved forward. When the ends of the actuator 160 are extended from the neutral position wherein the rotational axis 154 is parallel to the axis 94, the wheel mount 132 and rear wheels 152 will pivot in a clockwise direction about the pivot axis 142 such that the saw 20 will turn toward the right when the saw 20 is moved forward.

The power supply device 120 is coupled in fluid communication with the hydraulic drive units 148. The power supply device 120 may be operatively coupled to and driven by the accessory shaft 49 of the motor 46 or may be electrically powered. The power supply device 120 provides pressurized hydraulic fluid to the hydraulic drive units 148 to thereby rotate the drive shafts 150 and rear wheels 152 in either a counter-clockwise direction about the axis 154 as shown in FIG. 1 to provide forward motion to the saw 20, or in a clock-wise direction about the axis 154 as shown in FIG. 1 to provide rearward motion of the saw 20, as desired.

The saw 20 includes a dash plate 170 on which one or more controls are mounted. A motor throttle control 176 is attached to the dash plate 170 and is operatively coupled to the motor 46. A drive speed control 180 is attached to the dash plate 170 and is operatively coupled to the power supply device 120 and thereby to the hydraulic drive units 148. The drive speed control 180 is selectively moveable by the operator between a neutral position wherein the rear wheels 152 are not rotated by the hydraulic drive units 148, a forward position wherein the hydraulic drive units 148 rotate the rear wheels 152 in a forward rotational direction, and a reverse position wherein the hydraulic drive units 148 rotate the rear wheels 152 in a rearward rotational direction. The drive speed control 180 is adapted to selectively vary the speed of rotation of the rear wheels 152 and thereby control the speed at which the saw 20 moves with respect to the surface to be cut. The drive speed control 180 may have a variable speed setting. The rotational speed of the saw blade is controlled as a direct function of the motor throttle control 176. The motor throttle control 176 enables an operator to manually select the RPM at which the motor 46 operates and thereby the RPM at which the saw blade operates. The saw 20 may include a tachometer and other operating gauges and instruments operatively coupled to the motor 46 for displaying the RPM and other conditions at which the motor 46 is operating.

A saw blade lift control 182 is operatively connected to the power supply device 120. The saw blade lift control 182 enables an operator to selectively raise or lower the blade mounting member 60 to a desired position with respect to the surface to be cut through operation of the actuator 114 of the lift mechanism 100. A steering control 184 is operatively coupled to the power supply device 120 and thereby to the actuator 160. The steering control 184 enables an operator to selectively pivot the steering assembly 130 and thereby steer the saw 20.

The saw 20 also includes a fuel tank in fluid communication with the motor 46. A fuel gauge 188 is operatively connected to the fuel tank and provides an indication of the amount of fuel remaining in the fuel tank. The rotary engine 46 may be operated using gasoline, or it may be operated on propane and other fuels as desired. The ability to run the rotary motor 46 on propane enables the saw 20 to be used in close indoor locations.

In use, an operator starts the motor 46 and adjusts the saw motor throttle control 176 such that the motor 46 is operating at a desired RPM wherein the saw blade attached to the blade mounting member 60 is rotating at its recommended RPM. The saw blade and the saw 20 are aligned with the cutting path by aligning the cutting guide 196 onto the cutting path guide line. The operator then operates the saw blade lift control 182 to lower the rotating saw blade down into the concrete to a desired cutting depth. The operator then places the drive speed control 180 in the forward position, whereupon the hydraulic drive units 148 rotate the rear wheels 152 to provide forward movement to the saw 20 as the saw blade continues to cut the concrete. The operator can control left and right movement of the saw 20 during cutting by operation of the steering control 184 which controls the actuator 160 and the pivotal movement of the rear wheels 152 about the pivot axis 142. Control of left or right movement can be utilized to steer the saw along a curvilinear path as well as to counter pulling forces that would otherwise move the saw off an intended straight cut.

The hydraulic steering control assembly 130 enables an operator to efficiently operate the saw 20, although the saw 20 requires more timely and accurate control of its steering due to the faster operation and higher forces provided by the rotary motor 46 and power transmission system. In addition, as concrete saws tend to veer to the right during operation due to the rotation of the saw blade, the hydraulic powered steering assembly 130 of the saw 20 compensates for the increased power provided by the rotary motor 46 and power transmission system as the hydraulic steering assembly 130 does not require the operator to exert constant appreciable force on the saw 20 in order to control its direction or speed of movement. The strength and size of the operator is therefore less of a factor in operation of the saw 20. In addition, the saw 20 can be operated by a single operator for a longer period of time as operation of the saw 20 does not fatigue the operator to the same degree as current art.

Different diameter saw blades can be used with the saw 20 depending upon the cutting conditions, such as the depth of cut that is required. When a first saw blade having a first diameter is to be replaced with a second saw blade having a larger or smaller second diameter, the RPM of the motor 46 can be adjusted to rotate the second saw blade at its recommended RPM while still supplying relatively constant amounts of torque. While the RPM of the motor 46 may be adjusted upwardly or downwardly to compensate for different diameter saw blades, the horsepower and torque output of the rotary motor 46 over this range of RPM remains substantially constant compared with the horsepower and torque output drop that results from changing the RPM of a reciprocating motor away from its narrow ideal range. The use of reciprocating motors in concrete saws is compromised by their relatively narrow recommended RPM range and steep torque curve outside that range. This limits the ability of the saw to operate a range of blade sizes without exceeding the specifications of the engine, the blade, or both, or requires operation using less than optimal torque. Review of current art will show that some saw manufacturers offer several variations of a saw model (e.g. 65 hp) with each variation set up for use with a single different blade size and recommended operation at a single RPM setting unique to that blade size. The flat torque curve and high RPM range of the rotary motor 46 combined with the RPM reducing power transmission system eliminates operation under such conditions or limitations. Consequently the rotary motor 46 of the saw 20 can always supply adequate power while being operated within its specified RPM range of operation, while different diameter saw blades may be used with the saw 20 that are also operated at their recommended RPM. The motor 46 and saw blades are always operated within their RPM specifications. No changing of pulleys or other components is required in order to maintain the motor and saw blades rotating at their specified RPM. The durability, efficiency and reliability of the motor and saw blade are thereby enhanced.

The rotary motor 46 provides sufficient horsepower in a small physical size such that the overall size of the saw 20 is substantially reduced from prior concrete saws. Even the 170 peak HP saw 20 has a width between the outside surfaces of the side panels 28 that is sufficiently narrow to fit through a typical 36 inch wide door comparable to reciprocal powered saws of substantially lower power. The saw 20 with a rotary motor therefore can be used in places where a prior concrete saw could not be used due to its size. It allows the use of high torque for faster cutting without requiring as large and cumbersome of a platform as existing art.

Figure 6:
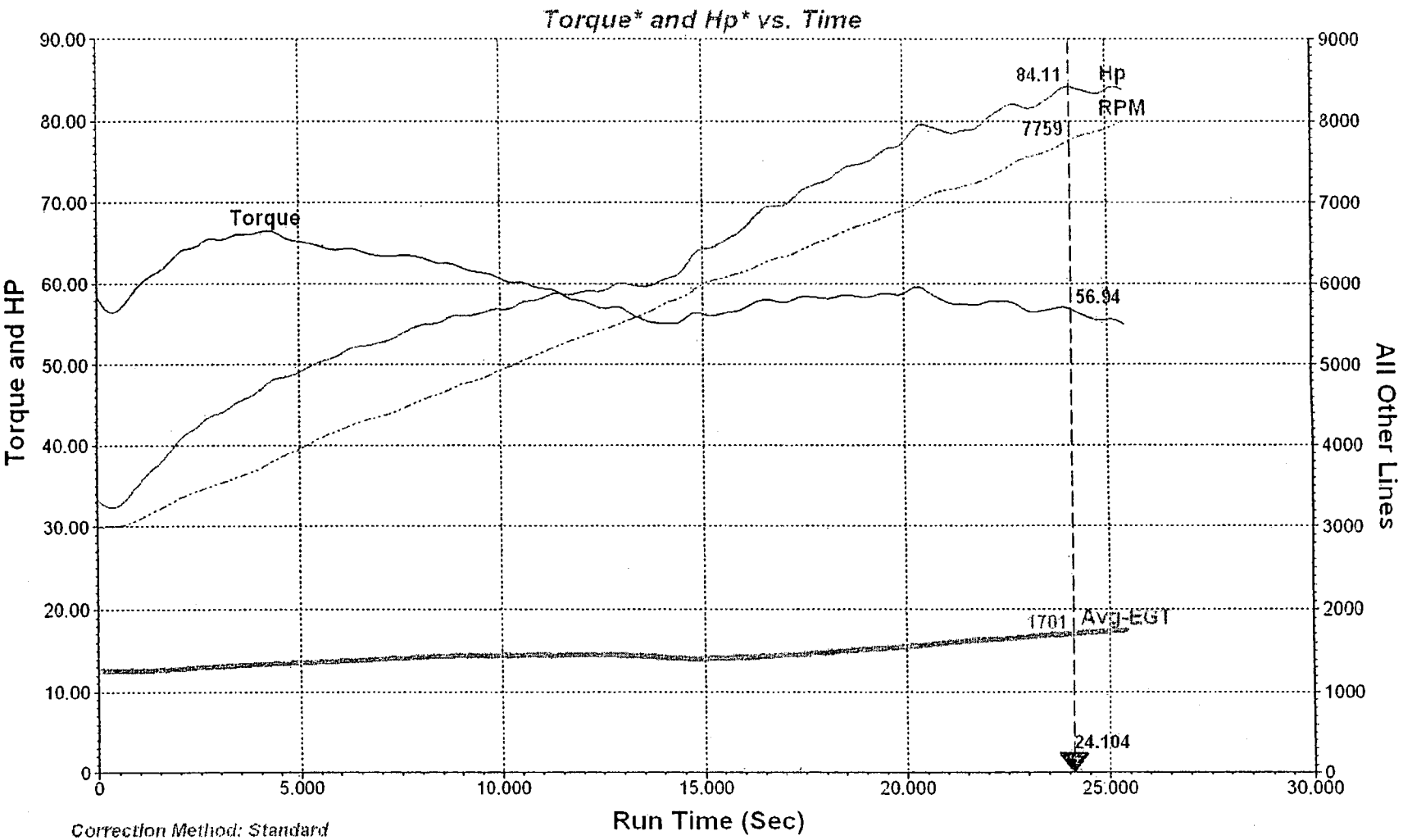
FIG. 6 is an illustration of the torque curve of the rotary motor employed.

The torque levels of the saw 20 are well in excess of current art in comparable footprint size and HP ratings. This can be illustrated by comparing the ratio of torque at the blade to the size of the saw between current art and the rotary powered saw. Size of the saw can be proxied by the minimum width through which the saw can pass, which equates to the maximum overall width of the saw. The table below assumes a typical 1-to-1 pulley setup on the reciprocating engines due to their limited RPM range in which their torque peaks (which also limits the variety of blade sizes that can be run within specifications.) This comparison, while showing results favoring the rotary motor saws, is arguably understated as the data presented exhibits peak torque generation of the reciprocating engines which can decrease dramatically as RPM changes. The torque of the rotary powered saws will remain virtually constant throughout its operating range of 2000 RPM to 5600 RPM at the motor output shaft 48 as shown in FIG. 6. A larger ratio of torque to minimum clearance ostensibly means a more powerful saw for a given footprint. The saw 20, with the 85HP rotary motor 46, has a torque to overall width ratio of 4.0 to 1.0 or greater, and preferably at least approximately 4.33 to 1.0. The saw 20, with the 170HP rotary motor 46, has a torque to overall width ratio of 7.0 to 1.0 or greater, and preferably at least approximately 9.72 to 1.0.

| Engine Employed | Min. Clearance | Peak Torque | Ratio |
|---|---|---|---|
| V6 reciprocating 120 hp | 36" | 240 ft-lbs | 6.67 |
| Deutz diesel 78 hp recip. | 43" | 177 ft-lbs | 4.11 |
| Wisconsin 65 hp recip. | 36" | 135 ft-lbs | 3.75 |
| Honda twin 18 hp recip. | 26" | 32 ft-lbs | 1.23 |
| Rotary 85 hp | 30" | 130 ft-lbs | 4.33 |
| Rotary 170 hp | 36" | 350 ft-lbs | 9.72 |

The use of a rotary motor 46 requires improved balancing of the components of the saw 20 to distribute weight in a favorable manner. The saw 20 requires sufficient weight over the saw blade to maintain the saw blade in the concrete during cutting and to assist in preventing the blade from walking out of the cut. This is accomplished by positioning of the motor 46 and other components relative to the saw blade, and by increasing the weight of the panels 24, 26 and 28 of the saw housing. The panels 24, 26 and 28 may be formed from steel having a thickness of at least approximately one-half inch to approximately three-quarter inch. These heavy duty steel panels also add strength to the housing and durability to the saw 20 improving its reliability and operating life. The saw 20 will operate with substantially reduced vibration as opposed to prior slab saws.

The saw blades may be diamond tipped and are consequently a very expensive consumable component of the cutting process. The amount of torque driving the rotation of the blade determines the ability of the blade to bite through the material it is cutting. The saw 20 and its rotary motor 46 and power transmission system provide vastly increased torque to the saw blade while maintaining the required RPM of the saw blade. The saw blade thereby has more cutting action or bite per rotation than provided by prior slab saws. This increase in efficiency of operation of the saw blade results in faster cutting action without requiring an increase in RPM and is believed to increase the life of the saw blade and increase the amount of cutting for a given time frame.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the invention are desired to be protected. The applicant has provided descriptions and figures which are intended as an illustration of certain embodiments of the disclosure, and are not intended to be construed as containing or implying limitation of the disclosure to those embodiments. There is a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods that incorporate one or more of the features of the disclosure and fall within the spirit and scope of the present disclosure.

What is claimed is:

1. A saw for cutting a surface with a rotatable blade, the saw including:

a frame base;

a rotary motor attached to the frame base, the rotary motor having one or more rotatable tri-lobular rotors, and an output shaft adapted to rotate about a first rotational axis;

a blade mounting member adapted to rotate about a second rotational axis, the blade mounting member being coupled to the output shaft of the rotary motor such that rotation of the output shaft causes rotation of the blade mounting member;

a steering assembly coupled to the frame base, the steering assembly including one or more first wheels;

whereby the rotary motor is adapted to rotate the blade mounting member and the blade such that the blade is adapted to cut the surface and the steering assembly is adapted to steer the saw.

2. The saw of claim 1 wherein the one or more rotors of the rotary motor are adapted to rotate the output shaft throughout a range of RPM and without a significant change in torque to allow the use of multiple blade sizes within their specifications without changing the saw setup.

3. The saw of claim 1 wherein the rotary motor is adapted to provide at least approximately 130 foot-pounds of torque at the blade and the overall width of the saw does not exceed approximately thirty inches.

4. The saw of claim 1 wherein the ratio of torque in foot-pounds provided at the blade by the rotary motor to the overall width of the saw in inches is at least approximately 4.0 to 1.0 without restricting the useable RPM range of the motor.

5. The saw of claim 1 wherein the one or more first wheels are rotatably attached to a wheel mount, the one or more first wheels being rotatable with respect to the wheel mount about a third rotational axis, the wheel mount being pivotally attached to the frame base such that the wheel mount and the one or more first wheels are selectively pivotal with respect to the frame base about a pivot axis, the pivot, axis being generally perpendicular to the third rotational axis.

6. The saw of claim 5 including an actuator for selectively pivoting the wheel mount and the one or more first wheels about the pivot axis with respect to the frame base.

7. The saw of claim 6 wherein the actuator comprises a hydraulic cylinder, the saw including a power supply device for operating the hydraulic cylinder.

8. The saw of claim 7 including a hydraulic drive unit, operatively coupled to one of the one or more first wheels and to the power supply device, the hydraulic drive unit adapted to selectively rotate the first wheel.

9. The saw of claim 1 including a power transmission system operatively coupling the output shaft of the rotary motor with the blade mounting member, such that rotation of the output shaft of the rotary motor causes rotation of the blade mounting member at a reduced RPM level and an increased torque level over a range of blade sizes.

10. The saw of claim 9 wherein the power transmission system includes a first belt coupling the output shaft of the rotary motor a rotatable shaft, and a second belt coupling the rotatable shaft to the blade mounting member.

11. The saw of claim 1 including a mounting frame slidably attached to the frame base, the rotary motor being attached to the mounting frame such that the rotary motor is selectively slidable with respect to the frame base.

12. A saw for cutting a surface with a rotatable blade, the saw including:

a rotary motor having one or more rotatable tri-lobular rotors, and an output shaft adapted to rotate about a first rotational axis;

a blade mourning member adapted to rotate about a second rotational axis, the blade mounting member adapted to receive the blade such that the blade is conjointly rotatable with the blade mounting member about the second rotational axis; and a power transmission system coupling the output shaft of the rotary motor with the blade mounting member such that rotation of the output shaft of the rotary motor causes rotation of the blade mourning member at reduced RPM and increased torque;

whereby the rotary motor is adapted to rotate the blade mounting member and the blade such that the blade is adapted to cut the surface.

13. The saw of claim 12 wherein the one or more rotors of the rotary motor are adapted to rotate the output shaft throughout a range of RPM and without a significant change in torque to allow the use of multiple blade sizes within their specifications without changing the saw setup.

14. The saw of claim 12 wherein the rotary motor is adapted to provide at least approximately 130 foot-pounds of torque at the blade and the overall width of the saw does not exceed approximately thirty inches.

15. The saw of claim 12 wherein the rotary motor is adapted to provide at least approximately 350 foot-pounds of torque at the blade and the overall width of the saw does not exceed approximately thirty six inches.

16. The saw of claim 12 wherein the ratio of torque in foot-pounds provided at the blade by the rotary motor to the overall width of the saw in inches is at least approximately 7.0 to 1.0 without restricting the useable RPM range of the motor.

17. A method of operating a saw having a rotary motor including one or more rotatable tri-lobular rotors for cutting a surface with a rotatable blade, the method comprising the steps of:

adjusting the operating speed of the one or more tri-lobular rotors of the rotary motor such that the rotary motor rotates the blade at a desired rotational speed;

moving the saw and the blade along the surface to be cut;

pivoting one or more first wheels of the saw about a substantially vertical axis with respect to the surface to be cut.

18. The method of claim 17 including the step of selectively pivoting one or more second wheels about a horizontal axis to vertically position the blade with respect to the surface to be cut.

19. A saw for cutting a surface with a rotatable blade, the saw including:

a frame base;

a rotary motor attached to the frame base, the rotary motor having an output shaft adapted to rotate about a first rotational axis;

a blade mounting member adapted to rotate about a second rotational axis, the blade mounting member being coupled to the output shaft of the rotary motor such that rotation of the output shaft causes rotation of the blade mounting member;

a steering assembly coupled to the frame base, the steering assembly including one or more first wheels, the one or more first wheels being rotatably attached to a wheel mount, the one or more first wheels being rotatable with respect to the wheel mount about a third rotational axis, the wheel mount being pivotally attached to the frame base such that the wheel mount and the one or more first wheels are selectively pivotal with respect to the frame base about a pivot axis, the pivot axis being generally perpendicular to the third rotational axis;

an actuator for selectively pivoting the wheel mount and the one or more first wheels about the pivot axis with respect to the frame base, the actuator comprising a hydraulic cylinder;

a power supply device for operating the hydraulic cylinder; and whereby the rotary motor is adapted to rotate the blade mounting member and the blade such that the blade is adapted to cut the surface, and the steering assembly is adapted to steer the saw.

* * * * *